United States Patent [19]

Schoenfield et al.

[11] 4,360,988

[45] Nov. 30, 1982

[54] TOY ASSEMBLY LINE FOR TOY MOTOR VEHICLE

[75] Inventors: Palmer J. Schoenfield, Evanston; Harry Disko, South Barrington, both of Ill.

[73] Assignee: Marvin Glass & Associates, Chicago, Ill.

[21] Appl. No.: 224,886

[22] Filed: Jan. 14, 1981

[51] Int. Cl.[3] ..... A63H 33/30

[52] U.S. Cl. ..... 46/39; 46/12

[58] Field of Search ..... 46/39, 40, 202, 12, 46/1 R, 17, 16

[56] References Cited

U.S. PATENT DOCUMENTS

| | | | |
|---|---|---|---|
| 3,466,043 | 9/1969 | McRoskey et al. | 46/202 X |
| 3,670,450 | 6/1972 | Morosawa | 46/40 |
| 4,226,044 | 10/1980 | Thomas | 46/202 X |

*Primary Examiner*—Mickey Yu

*Attorney, Agent, or Firm*—McDermott, Will & Emery

[57] ABSTRACT

A toy assembly line for toy motor vehicles comprises a base having an elongated assembly line for movement of the vehicles during assembly at a plurality of spaced apart assembly stations along the line. A mechanism is provided for moving the vehicles in partially completed condition between the assembly line stations along the line and an initial assembly station at one end of the line includes a mechanism for positioning a chassis of the vehicle ready for movement along the line towards the next station. A final assembly station at the opposite end of the line includes mechanism for securing the vehicle body as a final step on the vehicle chassis to finish or complete the assembly of the toy motor vehicle and a number of intermediate assembly stations are provided for assembly of wheels and axles onto the chassis, a motor on the chassis which helps to secure one of the axles in place and a seat on the chassis which helps in securing the motor in place, and finally the body is assembled onto the chassis to secure the remaining axle and the seat in place to finish assembly of the toy vehicle.

20 Claims, 16 Drawing Figures

TOY ASSEMBLY LINE FOR TOY MOTOR VEHICLE

BACKGROUND OF THE INVENTION

1. Field of the Invention

The present invention relates to a new and improved toy assembly line for toy motor vehicles and the like and comprises a toy assembly line resembling a real life assembly line for automobiles. A novel toy motor vehicle is provided which specially lends itself towards assembly in a manner simulating that of an actual automobile production assembly line.

2. Description of the Prior Art

A toy assembly plant for vehicles is shown in U.S. Pat. No. 3,670,450.

OBJECTS OF THE INVENTION

It is an object of the invention to provide a new and improved toy assembly line for toy motor vehicles and more particularly a toy assembly line including means for moving vehicles in a partially assembled condition between different assembly stations positioned along the line until a final assembly operation is completed.

Another object of the invention is to provide a new and improved toy assembly line for toy motor vehicles and the like wherein each additional component assembled onto the vehicle is utilized to aid in securing the previously assembled component in place.

Still another object of the present invention is to provide a new and improved toy motor vehicle especially adapted for assembly on a toy assembly line of the character described.

SUMMARY OF THE INVENTION

The foregoing and other objects of the present invention are accomplished in a new and improved toy assembly line for toy motor vehicles and the like which comprises a base forming an elongated assembly line for movement of the vehicles during assembly of components thereon between a plurality of separate assembly stations along the line. A manually actuated conveyor is provided for moving the vehicles between the various assembly stations along the line from an initial assembly station at one end of the line wherein a chassis of a vehicle is moved onto the line for movement towards subsequent assembly stations. A final assembly station is provided at the opposite end of the line and includes means for placing a vehicle body onto a chassis subassembly as a final assembly step.

In accordance with the invention, a toy motor vehicle is provided and is especially adapted for assembly on the line. The vehicle includes a chassis with a guide thereon for guiding the chassis to move along the assembly line as components are added. A pair of axles having wheels at opposite ends are mounted in spaced apart positions on the chassis at a next assembly station followed by a motor which is assembled onto the wheeled chassis in interlocking relation to engage one of the axles and hold the axle in place. Additionally, the toy vehicle includes a seat which is assembled onto the chassis and is utilized to secure the other axle in place and finally, a body is assembled onto the subassembly to secure and hold the seat in place to complete the vehicle.

BRIEF DESCRIPTION OF THE DRAWINGS

For better understanding of the present invention reference should be had to the following detailed description taken in conjunction with the drawings, in which:

FIG. 6 is a top plan view of the toy assembly line of FIG. 1;

FIG. 6 is a fragmentary, transverse, vertical cross-sectional view taken substantially along lines 16—16 of FIG. 14.

DESCRIPTION OF A PREFERRED EMBODIMENT

Figures 1, 2, 3, 4, 5:
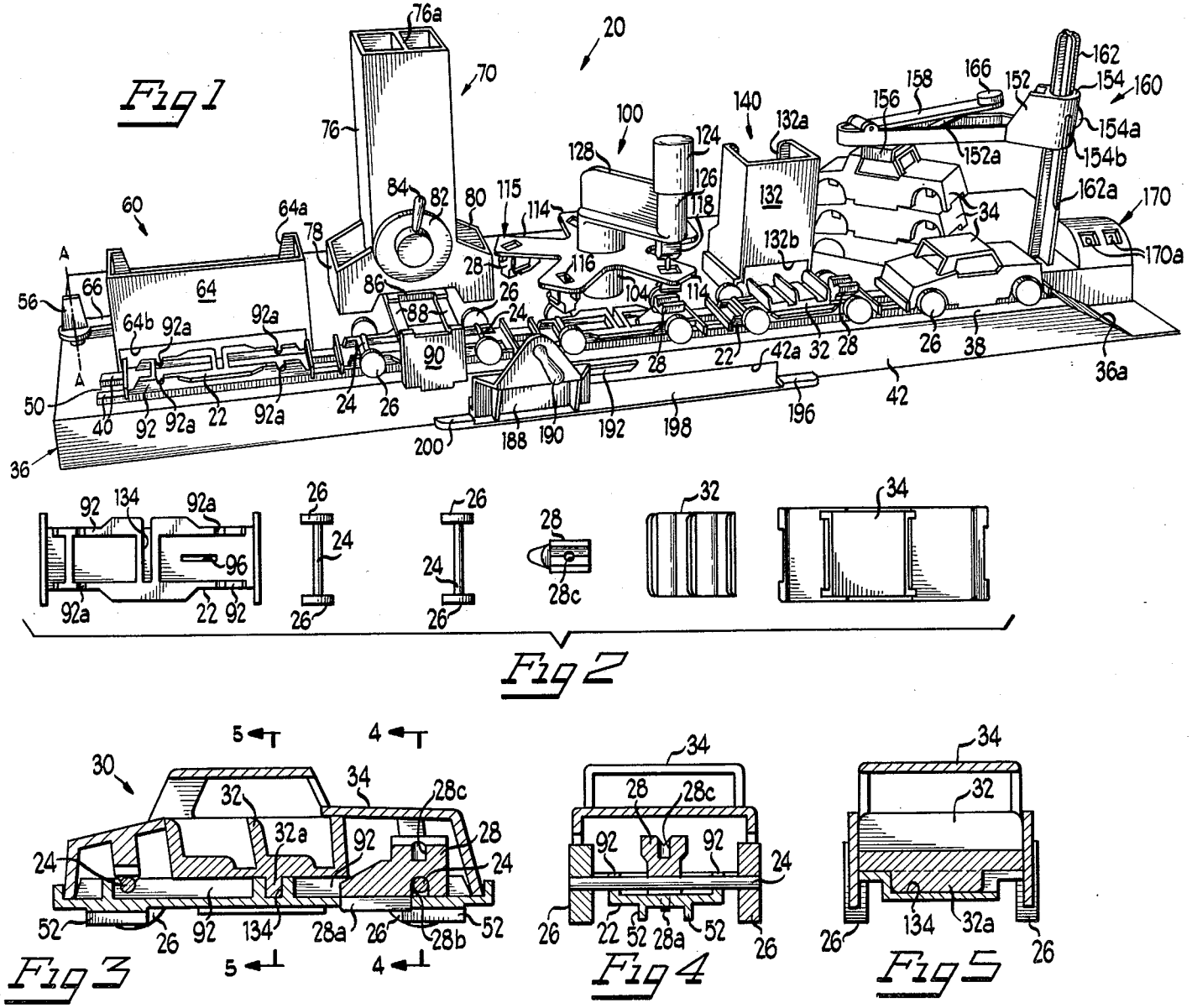
FIG. 1 is a perspective view of a new and improved toy assembly line for toy motor vehicles constructed in accordance with the features of the present invention.
FIG. 2 is a top plan view of a plurality of individual components of a toy motor vehicle constructed in accordance with the invention and arranged in a line in the order of assembly on the toy assembly line.
FIG. 3 is a longitudinal, vertical cross-sectional view through an assembled toy motor vehicle constructed in accordance with the features of the present invention.
FIG. 4 is a transverse, vertical cross-sectional view taken substantially along lines 4—4 of FIG. 3.
FIG. 5 is a transverse, vertical cross-sectional view taken substantially along line 5—5 of FIG. 3.

Referring now more specifically to the drawings, in FIG. 1 is illustrated a new and improved toy assembly line 20 constructed in accordance with the present invention and especially adapted for the assembly of toy motor vehicles or automobiles 30, (FIG. 3), comprising a plurality of components which are assembled together to form the completed vehicle on the assembly line of the present invention.

The vehicle 30 includes a chassis 22, a front and a rear axle 24, each having wheels 26 at opposite ends, a simulated motor or engine 28, a seat structure 32 and a body or outer shell 34 which is secured onto the chassis in a final assembly step at a last station on the assembly line 20 as will be described hereinafter. The individual components of the toy vehicle 30 are illustrated in FIG. 2 in a line that is in ordered relation corresponding to the sequence of steps of assembly on the toy assembly line.

In accordance with the present invention, the toy assembly line 20 includes an elongated base structure 36 having a generally rectangular-shaped floor or wall 38 supported at an elevated position above a playing surface by an integrally formed downwardly projecting peripheral wall including longitudinal front and rear walls 42 and 44, and transverse opposite end walls 46 and 48. Adjacent and parallel of the front wall, the floor or top 38 of the base is formed with a pair of elongated, upstanding, spaced apart guide rails 40 which form therebetween a shallow channel or groove defining the center of an elongated assembly line or path 50 along which the vehicles move during the assembly process.

As illustrated best in FIGS. 3 and 4 on the underside of the vehicle chassis 22 there is provided a pair of downwardly extending ribs 52 adjacent the front and rear axles and these ribs are adapted to fit in keyed sliding engagement with the guide rails 40 of the assembly line to insure smooth linear relative movement as the chassis moves along during the assembly process.

Referring now to FIGS. 1, 6, 7 and 8, at the left hand end of the base 36 as viewed in FIG. 1, the assembly line 50 is provided with a first assembly station 60, at which a chassis 22 is moved onto position on the assembly line for movement toward a next assembly station down the path. Referring to FIG. 6, the inner one of the guide rails 40 is formed with an elongated or opening slot **40*a* therein and a U-shaped rib 40*b* is positioned in this area. The U-shaped rib includes a bight portion aligned with the rail at opposite ends of the slot and a pair of legs extending laterally thereof toward the center line of base 36. The legs of the U-shaped rib supports a stack of chassis 22 contained in a vertical stack offset from the assembly line toward the center of the base 36. Chassis in the stack are guided for vertical displacement by means of a hollow, tubular wall structure 64 having a loading slot 64*a* in a back wall thereof and a feed slot 64*b* in a lower portion of a forward wall thereof designed to permit the lowest chassis in the stack to be moved out laterlly into place onto the assembly line path 50**.

Figures 7, 8:
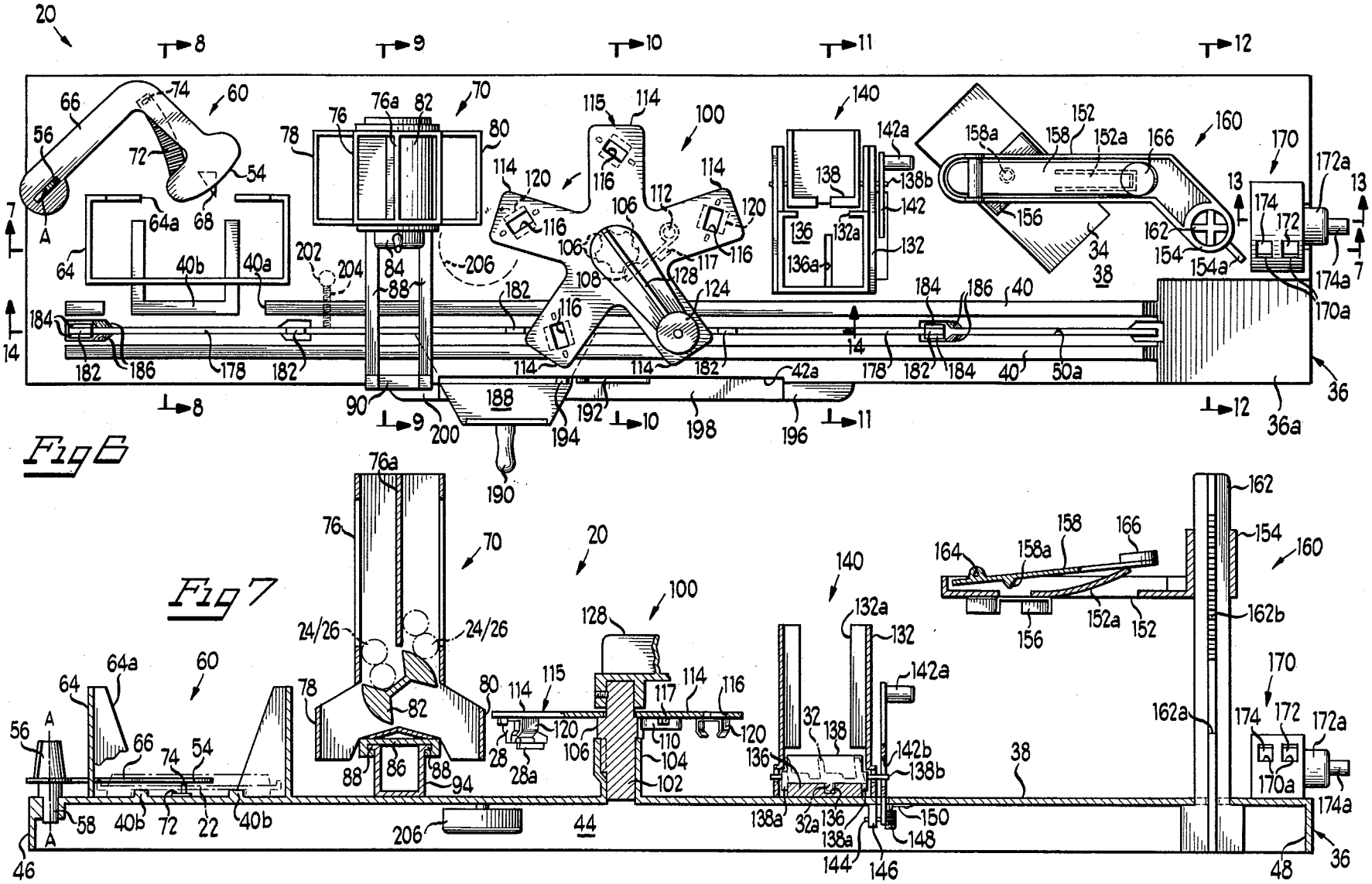
FIG. 7 is a longitudinal vertical cross-sectional view taken substantially along lines 7—7 of FIG. 6.
FIG. 8 is a transverse, vertical cross-sectional view taken substantially along lines 8—8 of FIG. 6.

In order to feed the lowest chassis in the stack onto the assembly line 50 the first assembly station 60 includes an L-shaped feed element 66 (FIG. 6) mounted for pivotal movement about a vertical axis "A—A" extending upwardly of the base structure top wall 38. The feed element includes a long leg with a shorter leg at the outer end and the outer end of the shorter leg is formed with an enlarged, oval shaped, chassis engaging pusher 54 adapted to extend through the slot **64*a* in the back wall of the stack support structure 64 when the L-shaped element 66 is rotated in a clockwise direction from the rest position shown in FIG. 6 to force the lowest chassis in the stack outwardly onto the assembly line rails. An upstanding trapezoidal-shaped manual tab 56 is provided on the L-shaped feed element 66 on the axis "A—A" to facilitate movement of the L-shaped element and a dependent spindle 58 extends downwardly into a cylindrical opening in the base 36 as shown in FIG. 7 to journal the L-shaped element for pivotal movement between the retracted or rest position of FIG. 6 and an ejection position (not shown) wherein the lowest chassis 22 in the stack is fed outwardly onto the assembly line path 50**.

The guide ribs 52 on each chassis 22 are aligned in keyed engagement between the inside facing surface of respective guide rails 40 so that the chassis will move smoothly in a longitudinal direction down the rails with the ribs guiding against lateral displacement. The legs of the U-shaped rib **40*b* support the ribs 52 of each chassis during movement out onto the rails 40 at the first assembly station 60**.

After a chassis is moved out onto the rails as described, the L-shaped element 66 is rotated in a counterclockwise direction by the tab 56 back to the position shown in FIG. 6 and the next lowest chassis 22 in the stack contained in the wall structure 64 moves down to rest on the legs of the U-shaped rib **40*b*** ready for the next cycle of operation.

The oval shaped pusher portion 54 on the L-shaped feed element 66 is maintained at the proper elevational level to clear the upper surface of the U-shaped rib **40*b* by means of a triangular-shaped boss or projection 68 formed on the upper surface of the base 36** and the under surface of the feed element slides freely on the upper surface of this boss.

An arcuately shaped track 72 having a plurality of transverse ridges and grooves on the upper surface thereof (as shown in FIG. 6) is formed on the upper surface of the base and a downwardly depending finger 74 on the feed element 66 moves over the ridges to produce an audible sound each time another chassis from the stack is fed onto the assembly line at the first assembly station 60. This audible sound adds to the realism of the toy assembly line 20 during play and engagement between the finger 74 and the curved track 72 retains the feed element 66 in position until forcefully moved.

A second (wheel/axle) assembly station 70 is positioned next adjacent the first assembly station 60 along the assembly line and this station includes an upstanding chute structure 76 of generally rectangular transverse, horizontal cross-section having a dividing wall **76*a* down the center thereof forming a pair of vertical guideways for holding stacks of front and wheel/axle sets 24/26 which are dispensed downwardly to a pair of lower discharge outlet structures 78 and 80 aligned to discharge in sequence a pair of front and rear wheel-/axle sets onto an awaiting chassis 22 positioned on the assembly line 50 at the second assembly station 70. A rotary dispensing valve 82 is turned side to side by manual rotation of a knob and handle assembly 84 on the front side of the dispensing chute structure to discharge a front and rear wheel/axle set. The dispensing chute structure is carried on a channel-shaped base 86 (FIG. 7) which is disposed for sliding movement on a pair of support flanges 88 which extend transversely across the assembly line and are spaced a distance above the rails 40 to permit a chassis 22** to pass beneath the flanges into a position ready to receive a set of front and rear wheels and axles.

Figures 8, 9, 10, 11, 12, 13, 14, 15, 16:
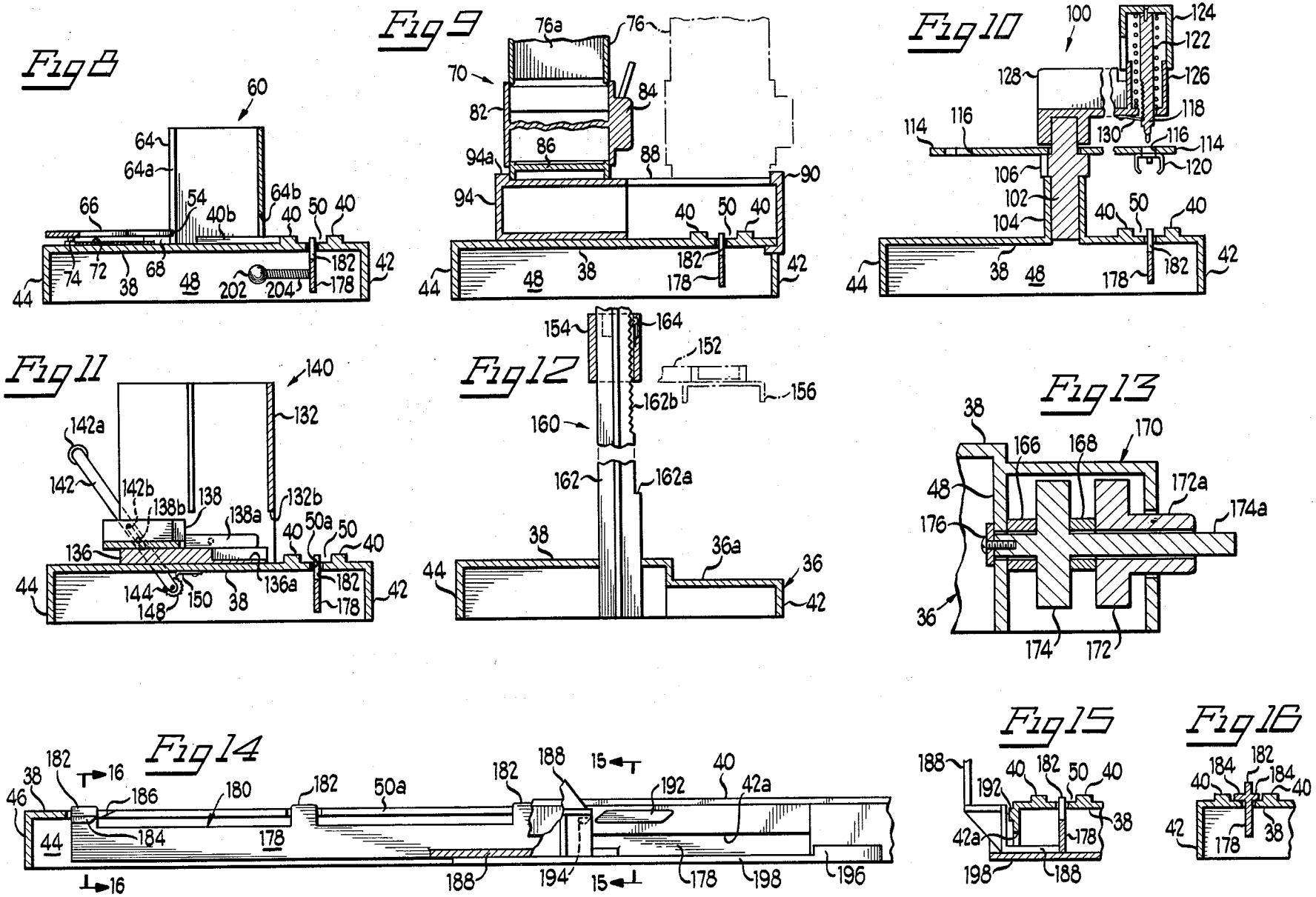
FIG. 9 is a transverse, vertical cross-sectional view taken substantially along lines 9—9 of FIG. 6.
FIG. 10 is a transverse, vertical cross-sectional view taken substantially along lines 10—10 of FIG. 6.
FIG. 11 is a transverse, vertical cross-sectional view taken substantially along lines 11—11 of FIG. 6.
FIG. 12 is a transverse, vertical cross-sectional view taken substantially along lines 12—12 of FIG. 6.
FIG. 13 is a longitudinal, vertical cross-sectional view taken substantially along lines 13—13 of FIG. 6.
FIG. 14 is a longitudinal, vertical cross-sectional view taken substantially along lines 14—14 of FIG. 6.
FIG. 15 is a transverse, fragmentary, vertical cross-sectional view taken substantially along lines 15—15 of FIG. 14.

The transverse flanges 88 supporting the dispensing chute structure 76 are in turn supported at the front end by an upstanding wall element 90 which has an upper edge portion extending slightly above the upper surface of the rails to provide a stop surface for engaging the base 86 of the chute structure when the structure is in a dispensing position as shown in dotted lines in FIG. 9. After the dispensing valve 82 has been operated by rotation of the valve control handle 84 to dispense a set of front and rear wheel and axles onto an awaiting chassis, the chute structure 76 is then movable on the flanges 88 back out of the dispensing position (as shown in dotted lines in FIG. 9) to an offset position shown in solid lines in readiness for the next cycle of operation at the assembly station 70.

The lower outlets 78 and 80 for the respective rear and front axle and wheel assemblies are positioned to lie directly above pairs of front and rear axle receiving notches or grooves **92*a* formed in the chassis 22 for receiving the axles. These grooves are formed on upstanding front and rear side flanges 92 which are provided on opposite longitudinal edges of the chassis 22 as best shown in FIGS. 3 and 4**.

The support flanges 88 for the dispensing chute structure 76 are supported at a rearward end, laterally offset from the assembly line 50 by a hollow tubular wall structure 94 secured on the base and having an upstanding back wall 94*a* (FIG. 9) which serves as a stop to limit the rearward movement of the wheel dispensing chute structure 76 away from the line 50.

After a set of front and rear wheel axles have been dispensed onto a chassis 22, the chassis subassembly is advanced from left to right along the assembly line from the second assembly station 70 to a third assembly station indicated generally by the numeral 100 whereat a motor or engine block 28 is dispensed into position on a front portion of the chassis above the front axle 24. The motor blocks 28 are formed with a depending key or fin 28*a* (FIG. 3) on the bottom along the center line thereof, which key is adapted to seat in an elongated slot 96 (FIG. 2) provided in the chassis 22. This key and slot interconnection helps to retain the motor block in place on the chassis.

As shown in FIG. 3, forwardly of the depending key 28*a*, the motor block is provided with a transverse groove 28*b* for accommodating the front axle 24 and helping to retain the axle in place on the chassis after the motor is seated in position on the chassis. As shown in FIG. 4, the motors 28 are also provided with a transverse vertical cross-section which resembles that of a common V-8 type engine and this cross-sectional shape facilitates the process of holding and dispensing motors from overhead onto an awaiting chassis 22 at the assembly station 100. The motors are formed with a vertically extending, cylindrical bore or slot 28*c* open at the upper end (as shown best in FIGS. 3 and 4) and adapted to aid in the proper positioning or centering of a motor onto an awaiting chassis.

The motor assembly station 100 includes a spindle 102 extending upwardly from an integral cylindrical support boss 104 formed on the top wall 38 of the base 36. The boss has a hollow bore to receive a lower end portion of the spindle as shown in FIG. 10 and the spindle is formed with a plurality of circumferentially spaced indexing teeth 106 provided at a level on the spindle immediately above the supporting boss structure 104. These indexing teeth cooperate with a pawl 108 (FIG. 6) carried at the free outer end of a detent spring 110. The opposite or fixed end of the pawl spring is coiled around a downwardly depending lug 112 formed on one of the arms 114 of a dispensing star-wheel-like structure 115. A depending lug 117 engages the spring 110 intermediate the ends to keep the pawl 108 positively engaged with the index teeth 106.

The star wheel 115 is journaled for free rotation on the spindle 102 at a point above the level of the detent teeth 106 and above the level of a chassis subassembly in position at the third assembly station 100. The engagement between the pawl 108 and the detent teeth 106 on the spindle 102 provides for controlled increments of angular rotation of the star wheel in a counterclockwise direction as viewed in FIGS. 1 and 6. A motor 28 is mounted on each arm 114 and is moved into a dispensing position, properly centered above the front axle of the chassis subassembly in position at the motor assembly station 100. Each arm 114 of the rotatable star wheel 115 is formed with a rectangular slot 116 adjacent the outer end and a longitudinal center axis of the slot is arranged at an angle with respect to the longitudinal axis of the arm 114 so that the slot will be coaxially aligned directly above the center line of the assembly line 50 when the particular arm is indexed into a dispensing position above the line.

Each rectangular slot is designed to accommodate a reciprocal, motor dispensing plunger 118 having a matching, rectangular-shaped, transverse cross-section so that the plunger can be extended downwardly through the slot to eject and position an engine or motor 28 onto the awaiting chassis beneath the arm 114. For this purpose, the plunger includes a pointed lower end and a depending cylindrical pin adapted to interfit with the V-shaped groove in the upper surface of an engine block (FIG. 4) and the pin is adapted to extend into a cylindrical recess 28*c* in the upper surface of the engine block. Accordingly, as the plunger 118 is moved downwardly, an engine block 28 is centered on the pin and properly aligned to move into alignment onto the front axle of a chassis 22 with the key or fin 28*a* readily inserted into the groove 96 thereof.

An engine or motor block 28 is manually mounted on the underside of each arm 114 of the star wheel 115 in sequence at a position away from the assembly line and a U-shaped spring clip 120 is provided on each arm having depending arms with inturned lower ends on each side of the slot 116 adapted to engage and support the upwardly and outwardly sloping side walls on opposite sides of a motor block to hold the block in place. A motor is snapped into place between the holding of the spring clips 120 and eventually the star wheel is rotated in increments as controlled by the pawl and teeth until the engine block is in a dispensing position in proper orientation above an awaiting chassis at the motor assembly station 100.

The plunger 118 is biased upwardly into a retracted position by a coil spring 122 and a cup-shaped cap 124 is mounted on the upper end of the plunger to provide a convenient pushing surface for dispensing an engine or motor 28 onto an awaiting chassis assembly. The cap 124 includes a cylindrical, depending skirt which is slideably disposed around a supporting upstanding cylindrical spindle 126 (FIG. 10) carried at the outer end portion of a radial support arm structure 128 which extends outwardly from the upper end of the vertical spindle 102. The plunger 118 is maintained in position directly above the center of the assembly line 50 and in proper orientation therewith. As shown in FIG. 10, the plunger is formed with a plurality of serrations or ridges and grooves on one side and these serrations are engaged by the end of a small leaf spring 130 which generates a noise when the plunger is moved vertically to dispense an engine block or motor 28 onto a chassis. The arm 128 and plunger 118 remain in fixed position relative to the upstanding spindle 102 and the star wheel 115 is rotated in incremental sequences to move successive engine blocks or motors 28 into position ready for dispensing.

In accordance with the present invention, the toy assembly line 20 includes a fourth station comprising a seat assembly station 140 which includes an upstanding structure 132, generally similar to the structure 64 and adapted to contain a stack of seats 32. The structure is open at the back as at 132*a* to facilitate loading and includes on the forward wall at the lower end portion an outlet slot 132*b*. The seats are fed through the slot onto the assembly line and are adapted to be assembled onto each chassis positioned on the conveyor rails 40 at the seat assembly station.

As best illustrated in FIGS. 3 and 5, each seat 32 includes a depending, transversely extending key or rib 32*a* which is adapted to seat or key into a matching, transversely extending key slot 134 formed on the car chassis 22.

The walls of the upstanding chute structure 132 are adapted to contain a vertical stack of seats 32 in proper orientation for sliding engagement of the key in the slot when the seats are moved laterally outwardly onto an awaiting chassis subassembly in a direction perpendicular to the assembly line. As this is done, the depending key or fin 32*a* on the seat slides into the transversely extending key slot or groove 134. As illustrated in FIG. 3, when the seat 32 is in place, the forward end thereof engages a top surface of a rearward sloping portion of the engine block 28 to aid in retaining the engine block in proper position on the chassis.

As best illustrated in FIGS. 1, 6, 7 and 11, the chute structure 132 includes a base plate 136 mounted on the top wall 38 of the base 36 and this base plate is formed with a slot or groove 136*a* open at an outer end in alignment with a key slot of a chassis 22 in ready position at the seat assembly station 140. A movable pusher 138 is mounted for lateral sliding movement toward and away from the assembly line 50 and the pusher includes a pair of parallel guide fingers 138*a* to guide the front and rear ends of the seat 32 as it is fed outwardly onto an awaiting chassis subassembly.

Movement of the pusher to feed successive seats 32 from the bottom of the stack out onto the assembly line is accomplished by a lever 142 having a handle 142*a* at the upper end and pivotally secured at a lower end on an axle 144 supported on a bracket 146 depending downwardly from the bottom surface of the base top wall 38 as shown in FIG. 7. The actuating lever is formed with an elongated slot 142*b* which accommodates a pin 138*b* on one side of the pusher and this pin and slot engagement provides a positive pushing force for moving the seats out into position. A ratchet wheel 148 is mounted on the lower end of the actuating lever 142 to rotate therewith and a leaf spring 150 having a deflectable end is engaged with the teeth on the ratchet gear to produce an audible sound each time the lever 142 is pivoted back and forth to feed a new seat from the stack outwardly onto the assembly line.

The toy assembly line 20 includes a final assembly station 160 wherein car bodies or outer shells 34 are assembled onto an awaiting chassis subassembly at the station. The final assembly station includes an upstanding pillar 162 formed by a pair of flat ribs intersecting one another at the center to provide a cross-like transverse horizontal cross-section. The pillar extends downwardly through a cross-shaped slot formed in the top wall 38 of the base 36 and is provided with an enlarged base portion beneath the surface of the wall 38 as shown in FIG. 7. The pillar provides support for an outwardly extending, cantilevered, arm 152 having an integral cylindrical bearing wall 154 slideably and rotatably disposed on the pillar and formed with a radial tab 154*a* for facilitating manual control of pivotal movement of the arm and vertical sliding movement of the arm to pick up and dispense a car body 34. The bodies are contained in a stack offset from the assembly line 50 and the arm is operable to pick up a body from the stack and move the body out to an assembly position for release to move downwardly onto a chassis subassembly at the final assembly station.

As best shown in FIGS. 6 and 7, the body of the arm 152 is of a channel-shaped transverse cross-section with a dog-leg shape. At the outer end of the arm, a body supporting, U-shaped clip 156 having dependent legs is provided for engaging opposite sides of a car body 34 in the stack to pick up the body and move it upwardly and swing it outwardly from the stack as the arm is pivoted in a counterclockwise direction (FIG. 6). In order to release or dispense a body onto the chassis assembly, the pick up arm is provided with a lever 158 pivotally secured on a cross-pin 164 extending transversely between opposite webs of the arm adjacent the rounded outer end as shown in FIGS. 6 and 7. At the opposite end, the lever is provided with a push button 166 on the upper surface and the lever is normally biased upwardly by a spring-like finger 152*a* which is struck from the web of the underlying arm 152 as shown in FIGS. 6 and 7. On the underside intermediate its ends, the lever is provided with a depending lug 158*a* which is adapted to move downwardly through a circular opening in the web of the arm and a similar hole in the bight portion of the clip 156.

The lug is adapted to engage and force a body 34 held by the clip downwardly onto an awaiting chassis. This is accomplished by downward pressure on the push button 166 after the dispensing arm 152 has been rotated away from the stack to align and center a body above the assembly line 50. Release of pressure on the button permits the spring 152*a* to pivot the lever 158 upwardly so that the lug 158*a* does not interfere with the pick up of the next body shell 34 in the stack with the legs of the body clip 156. Radial alignment of the arm 152 is aided by means of a vertical slot 154*b* (FIG. 1) formed in the lower edge of the cylindrical section 154 and the slot may be aligned with the ribs of the pillar to permit further downward travel of the arm below the level of stop surfaces 162*a*. Normally the surfaces 162*a* engage the lower edge of the section 154 and only when the arm is angularly aligned, to pick up a body 34 in the stack or dispense a body held on the clip 156 downwardly onto an awaiting chassis on the assembly line is the arm allowed to move to a lower lever on the pillar 162.

One of the ribs of the pillar 162 is formed with a plurality of serrations 162*b* along an intermediate portion of an outer edge and these serrations are engaged by a spring finger 164 so that a noise is generated when the arm is moved up and down the support pillar 162 to pick up and/or dispense a body shell 34 in the assembly process.

After the final assembly is completed, the completed vehicles 30 are moved from the final assembly station 160 down a sloping ramp 36*a* formed in the top wall 38 of the assembly line base structure 36. The toy vehicles as thus completed can be used in play or can be disassembled as desired and then reassembled on the toy assembly line 20.

Referring to FIGS. 3, 4 and 5, when a body shell 34 is finally assembled onto the chassis at the last assembly station 160, the depending front and rear edges of the body 34 are seated in grooves formed on the upper side of the chassis between front and rear bumpers and forward and rearward ends of the chassis side flanges 92. In addition, the hood structure of the body shell engages a forward wall of the seat structure 32 to help maintain the seat in place. As illustrated in FIG. 3, forward and rearward ends of the side flanges 92 are sloped or tapered to cam the lower edges of the front and rear walls of the body outwardly against the inside faces of the front and rear bumpers.

In accordance with the invention, the toy car assembly line 20 is provided with a veeder-root type manual counter for indicating the number of automobiles 30 that have been assembled. The counter and housing is referred to by the reference numeral 170 and includes a housing structure adjacent the right hand end of the base structure 36. The housing has a curved front wall with a units digit window and a tens digit window 170*a* formed therein. A units digit wheel 172 having appropriate digits 0–9 spaced around the circumference thereof is mounted in the housing on a horizontal rotational axis and is rotatable manually by means of a projecting sleeve 172*a* extending outwardly through an opening in the outer side-wall of the housing. The sleeve may be conveniently grasped for manual control of the wheel rotation to align an appropriate digit on the wheel to appear for viewing through the units' digit window in the housing front wall. A tens' digit wheel 174 is also mounted in the housing with a similar wheel and an integral shaft 174*a* extending coaxially outwardly past the outer end of the sleeve 172*a* is provided to facilitate manual rotation to align on appropriate digit to appear in the tens' digit window. A retaining washer and cap screw 176 are provided for securing the shaft 174*a* against longitudinal displacement and a pair of spacing collars or washers 166 and 168 as shown in FIG. 13 are provided to maintain position between the respective wheels and between the tens' digit wheel and an end wall 48 of the base structure 36.

In accordance with the present invention, the toy assembly line 20 also includes an elongated conveyor system generally indicated by the reference numeral 180 (FIG. 14), for moving the chassis and subassemblies thereof from one assembly station to the next until final assembly is completed. The conveyor includes an elongated rib 178 having a plurality of upwardly projecting fingers 182 formed at appropriate, longitudinal intervals along the upper edge. Forward edges of these ribs are adapted to engage the rear bumpers of a chassis 22 at each assembly station along the assembly line to move the chassis toward the next station when the rib is reciprocated longitudinally toward the final assembly station as will be described hereinafter.

Some of the fingers 182 are provided with cam elements 184 on opposite sides of the rib and right hand sloping edges of these cam elements are adapted to engaged fixed sloping cam surfaces 186 formed in the top wall 38 of the base structure on opposite sides of an assembly line slot or groove 50*a*.

When the conveyor rib 178 is moved toward the right as viewed in FIG. 14, the fingers 182 are elevated upwardly to raise the fingers so that the right-hand edges of the fingers extend above the surface of the rails 40 and engage the rear bumpers of the vehicle chassis to move the vehicles from one station to the next.

The path of movement of the rib 178 is controlled by a laterally upwardly extending handle structure 188 having a knob 190 to facilitate easy grasping. As shown in FIG. 14 the handle portion 188 extends outwardly through an elongated slot 42*a* in the front wall of the base structure 36. The inner end of the handle 188 is joined to a lower edge portion of the longitudinal rib 178 intermediate its ends. Each time the knob 190 is moved to the right toward the final assembly end of the base 36, the conveyor rib 178 is elevated and the fingers 182 engage the vehicles to move them along the line. To facilitate this action, an elongated parallelogram-shaped, fixed cam element 192 is provided on the front wall 42 of the base above the slot 42*a* and the handle structure includes an engaging cam element 194 which is engageable with the left hand end of the element 192 to raise rib 178 and the finger 182 thereon. Further travel in a horizontal direction causes each chassis on the line to move to the next assembly station. On a return stroke, the cam 194 engages the right hand end of the fixed cam element 192 to lower the rib 178 and retract the fingers 182. The rib is then returned horizontally from right to left.

Each advance stroke is limited by a stop lug 196 at the right hand end of the slot 42*a* formed on an outwardly extending support floor 198 of the base structure 36 and similarly a stop projection 200 is provided at the left hand end of the slot to limit the leftward travel of the handle structure on a return stroke.

A sound generating mechanism in the form of a spherical, clapper element 202 carried on a coil spring attached to the rib 178 is provided to strike against a bell 206 mounted on the underside of the top wall 38. The bell is struck on each advancing stroke of the conveyor rib 178 to indicate that another car has been assembled.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy assembly line for toy motor vehicles, comprising:

a base forming an elongated assembly line for movement of said vehicle during assembly along a plurality of assembly stations;

means for moving said vehicles in a partially completed condition between said assembly stations along said lines;

an initial assembly station at one end of said line including means for positioning a chassis for a vehicle in position for movement along said line towards the next station;

a manually operable means for positioning a vehicle part on said chassis; and a final assembly station at an opposite end of said line including means for securing the vehicle body on a vehicle chassis in position at the station to finish the assembly of a toy motor vehicle.

2. The toy assembly line of claim 1 including one or more additional assembly stations along said line between said initial and final assembly stations.

3. The toy assembly line of claim 2 wherein one of said additional assembly stations comprises means for mounting wheels and axles on a chassis of a vehicle in position at said station.

4. The toy assembly line of claim 2 or 3 wherein one of said additional assembly stations comprises means for mounting an engine on a chassis of a vehicle in position at said station.

5. The toy assembly line of claim 2 or 3 wherein one of said additional assembly stations comprises means for mounting seats on a chassis of a vehicle in position at said station.

6. The toy assembly line of claim 1 or 2 including a display counter for indicating the number of toy motor vehicles passing said final assembly station.

7. The toy assembly line of claim 3 wherein said one additional assembly station includes means for dispensing a plurality of axles having wheels at opposite ends for mounting at spaced apart positions on the chassis of said vehicle at said station.

8. The toy assembly line of claim 7 wherein said dispensing means includes a plurality of storage chambers for holding a stack of said axles with wheels thereon and manual operator means for dispensing an axle with wheels from each of said storage chambers onto the chassis of said vehicle at said station upon manual movement of said operator means from a first position to a second position.

9. The toy assembly line of claim 8 wherein said manual operator means is effective to dispense an axle with wheels from each storage chamber on the chassis of said vehicle at said station upon manual movement in a reverse direction from said second position to said first position.

10. The toy assembly line of claim 4 wherein said means for mounting an engine comprises first means for positioning an engine directly above the chassis of said vehicle at said engine mounting station and second means for dispensing said engine downwardly onto said vehicle chassis.

11. The toy assembly line of claim 10 wherein said first means includes an engine holder mounted for rotation on said base between first and second positions wherein a plurality of engines on said holder are moved successively into a dispensing position above said vehicle chassis at said station on said line.

12. The toy assembly line of claim 11 wherein said second means includes a manually depressable plunger operable to release an engine in said dispensing position from said holder to be mounted on said vehicle chassis.

13. The toy assembly line of claim 5 wherein said means for mounting seats on a chassis includes manually actuated slide means for moving seats laterally offset from said assembly line in a lateral direction to slideably engage an adjacent chassis of said vehicle at said additional seat assembly station.

14. The toy assembly line of claims 1 or 2 wherein said final assembly station includes means for picking up a body from a stack of bodies offset from said assembly line and positioning the body onto a vehicle chassis in position at said final assembly station.

15. The toy assembly line of claims 1 or 2 wherein said means for moving said vehicle includes an elongated element mounted for reciprocal movement longitudinally of said assembly line and including a plurality of spaced apart upstanding fingers for engaging said vehicles to move the same from one assembly station to the next as said element is moved in one direction along said line.

16. The toy assembly line of claim 15 wherein said assembly line includes elongated rail means for supporting said vehicles moving down said line and said element is aligned in parallel therewith.

17. The toy assembly line of claim 15 including cam means for elevating said fingers to engage and move said vehicles when said element is moved in said one direction along said line.

18. The toy assembly line of claim 17 including cam means for downwardly retracting said fingers out of engagement with said vehicle when said element is moved in an opposite direction along said line.

19. The toy assembly line of claim 18 including bias means for moving said elongated element to retract said fingers and toward said initial assembly station.

20. The toy assembly line of claim 19 including handle means to facilitate movement of said elongated element to elevate said fingers and advance said vehicle to station down said assembly line.

* * * * *